US005624080A

United States Patent [19]

Stehr et al.

[11] Patent Number: 5,624,080

[45] Date of Patent: Apr. 29, 1997

[54] AGITATOR MILL

[75] Inventors: Norbert Stehr, Grünstadt; Philipp Schmitt, Lampertheim, both of Germany

[73] Assignee: EVV-Vermögensverwaltungs-GmbH, Wiesloch, Germany

[21] Appl. No.: 525,142

[22] Filed: Sep. 8, 1995

[30] Foreign Application Priority Data

Sep. 9, 1994 [DE] Germany ..... 44 32 200.3

[51] Int. Cl.[6] ..... B02C 17/16

[52] U.S. Cl. ..... 241/80; 241/97; 241/171; 241/172

[58] Field of Search ..... 241/171, 172, 241/80, 97

[56] References Cited

U.S. PATENT DOCUMENTS 2,595,117 4/1952 Ahlimann .
4,062,497 12/1977 Kemp et al. ..... 241/171 X
4,496,106 1/1985 Gross .

FOREIGN PATENT DOCUMENTS

0146852B1 3/1987 European Pat. Off. .
3038794 5/1982 Germany .

*Primary Examiner*—Mark Rosenbaum
*Attorney, Agent, or Firm*—Browdy and Neimar

[57] ABSTRACT

An agitator mill is provided with a separate grinding-stock/auxiliary-grinding-body separator device, which comprises a rotor, drivable to rotate, for the separation of the auxiliary grinding bodies from the treated grinding stock. The auxiliary grinding bodies and untreated grinding stock are returned to the agitator mill. The separator device and the agitor mill and the lines connecting these two form a closed system.

11 Claims, 5 Drawing Sheets

AGITATOR MILL

BACKGROUND OF THE INVENTION

1. Field of the Invention

The invention relates to an agitator mill comprising a grinding receptacle enclosing a grinding chamber, an agitator unit rotatably disposed in the grinding chamber concentrically of the latter's axis, a drive motor coupled with the agitator unit, a grinding-stock/auxiliary-grinding-body discharge line leading out of the grinding chamber, a grinding-stock/auxiliary-grinding-body separator device separate from the agitator mill and connected to the discharge line, a grinding-stock supply and auxiliary-grinding-body return line connected to the separator device and a grinding-stock supply line on the one hand, and to the grinding chamber on the other, and a grinding-stock pump arranged in the grinding-stock supply line.

2. Background Art

An agitator mill of the generic type is known from DE 30 38 794 A1, in which the milled grinding stock and the auxiliary grinding bodies are removed from the grinding chamber by means of a worm conveyor and supplied to a riddler as a separator device. The riddler serves to isolate the grinding stock and auxiliary grinding bodies that have become too small and scraps of auxiliary grinding bodies; the auxiliary grinding bodies of sufficient size are supplied to a mixing hopper, to which grinding stock to be processed is supplied by means of a grinding-stock pump. The grinding stock to be processed and the auxiliary grinding bodies are supplied as a mix via a line to another worm conveyor that feeds this mix into the agitator mill. It is the purpose of these measures that a given pressure in the grinding chamber be maintained. Affecting the pressure in the grinding chamber is to become possible through modifications of the speed of the worm conveyors before the grinding chamber inlet and behind the grinding chamber outlet. This does not help achieve high grinding-stock throughputs.

An agitator mill is known from U.S. Pat. No. 4,496,106, in which the auxiliary-grinding-body return line opens into the grinding-stock supply line by an angle of 90° directly before the grinding-stock/auxiliary-grinding-body inlet. As a result of the centrifugal effect produced by the agitator unit, the auxiliary grinding bodies and grinding stock not sufficiently milled are to be catapulted off through the auxiliary-grinding body outlet and returned through the grinding-body return line. By the grinding-body return line opening into the grinding-stock supply line, a suction is to be generated, still supporting the centrifugal effect. Further, excellent preliminary mixing of the grinding stock and the auxiliary grinding bodies is to result in the grinding-stock supply line. Experience has shown that any reliable circulation of the auxiliary grinding bodies cannot be ensured by this design of the known agitator mill. The auxiliary grinding bodies get stuck in the auxiliary-grinding-body return line, where they stay. Although, owing to their basic concept, agitator mills of this type have considerable advantages where a high throughput of grinding stock is required that is marked by a considerable transport of auxiliary grinding bodies in the grinding chamber to the separator device, this type of agitator mills has not been successful in practice, because the circulation of the auxiliary grinding bodies does not work.

U.S. Pat. No. 2,595,117 discloses a dry-milling ball mill. In this ball mill, the milled grinding stock and the grinding bodies are removed in common through a discharge line and placed into a vertical air duct that serves as an air separator.

Air is blown from below through this vertical air duct, transporting all the smaller particles into a separator. The grinding balls and the coarse fraction of the grinding stock will fall downwards through the duct against the air stream and are returned to the mill via a conveyor worm. In the separator, sufficiently fine material is once again separated from the grinding stock not sufficiently milled. The latter is likewise fed to the worm via a line.

An agitator mill is known from EP 0 146 852 B1, comprising a grinding receptacle with a cylindrical inner wall and a cylindrical agitator unit, a grinding chamber being formed between the agitator unit and the inner wall of the grinding receptacle. On its free end, the agitator unit has a cavity, into which projects a separator device. In this area, the agitator unit is provided with recesses all around the separator device, the recesses allowing the auxiliary grinding bodies, which reach the cavity from the front of the free end of the shaft, to be discharged radially into the adjacent grinding chamber. There is the risk of auxiliary grinding bodies compacting in the vicinity of the free shaft end, i.e. around the cavity.

SUMMARY OF THE INVENTION

It is the object of the invention to embody an agitator mill of the generic type such that a high grinding-stock throughput is achieved.

According to the invention, this object is attained in that the grinding receptacle, the grinding-stock/auxiliary-grinding-body discharge line, the separator device and the grinding-stock supply and auxiliary-grinding-body return line form a closed system, and in that only the grinding-stock pump disposed in the grinding-stock supply line serves as a conveying device for grinding stock and auxiliary grinding bodies in the grinding-stock supply and auxiliary-grinding-body return line. The fact that solely the grinding process takes place in the grinding receptacle and that the separation of the grinding stock and the auxiliary grinding bodies takes place in the separator device ensures that a defined quantity of auxiliary grinding bodies is in the grinding chamber, the total quantity of auxiliary grinding bodies being given and defined quantities of auxiliary grinding bodies likewise being in the lines and the separator devices. The grinding chamber, the lines and the separator device constitute a closed system. Since the quantity of auxiliary grinding bodies in the grinding chamber can be defined and since no auxiliary-grinding-body retaining devices are arranged at the outlet of the grinding chamber, it is possible to realize a uniform distribution of the auxiliary grinding bodies in the grinding chamber without any additional measures. Since the separator device has a drive separate from that of the agitator unit, high throughputs can be run in the grinding chamber, a defined density of auxiliary grinding bodies in the grinding chamber being nevertheless possible. The separate separator device can be embodied and operated such that the problems otherwise occurring in particular with high throughputs in the agitator mill do not occur. Hydraulic transport of the auxiliary grinding bodies to the agitator mill takes place by means of the as yet untreated grinding stock serving as a transport medium. The agitator mill can be operated reliably at high throughputs, there being no risk of a block-up. Since the distribution of auxiliary grinding bodies in the grinding chamber is uniform as a result of the auxiliary grinding bodies circulating, high reproducibility of grinding stock fineness can be achieved with varying throughputs which may be very high.

Further features, details and advantages of the invention will become apparent from the ensuing description of four exemplary embodiments, taken in conjunction with the drawing.

DESCRIPTION OF THE PREFERRED EMBODIMENTS

Figure 1:
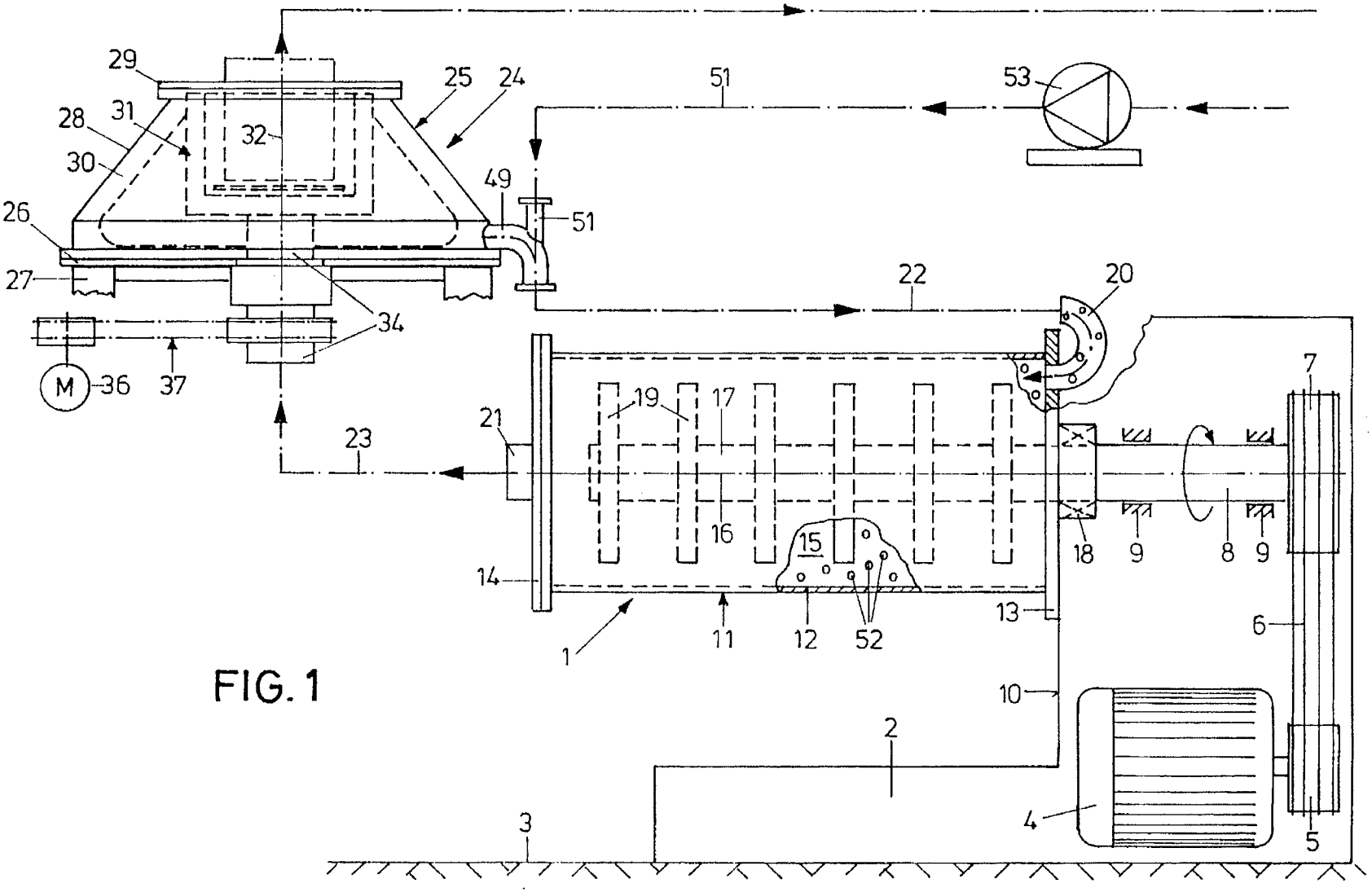
FIG. 1 is a diagrammatic illustration of a vertical section of a horizontal agitator mill with a separator device separated therefrom.

FIG. 1 illustrates a horizontal agitator mill 1, which conventionally comprises a stand 2 supported on the ground 3. The stand 2 houses a drive motor 4 which can be speed-variable, if required, which is provided with a V-belt pulley 5, by means of which a drive shaft 8 can be driven for rotation by way of a V-belt 6 and another V-belt pulley 7. The drive shaft 8 is rotatably run in several bearings 9 in the stand 2. A substantially cylindrical grinding receptacle 11 is fixed to a vertical end wall 10 of the stand 2. The grinding receptacle 11 has a cylindrical wall 12, its end facing the wall 10 of the stand 2 being closed by a lid 13 and its opposite end by a bottom 14. It encloses a grinding chamber 15.

An agitator shaft 17 passing through the lid 13 is disposed in the grinding chamber 15 concentrically of the common central longitudinal axis 16 of the grinding receptacle 11 and the drive shaft 8. The grinding chamber 15 is sealed by seals 18 between the lid 13 and the agitator shaft 17. The shaft 17 is cantilevered, i.e. it is not run on bearings in the vicinity of the bottom 14. Over its entire length within the grinding chamber 15, it is provided with agitator elements 19, which are agitator disks in the present case.

In the vicinity of the lid 13, a supply connector 20 opens into the grinding chamber 15 for the supply of grinding stock to be treated. In the vicinity of the free end of the agitator shaft 17, a discharge connector 21 discharges from the grinding chamber 15, which, in the present embodiment, is disposed concentrically of the axis 16 in the bottom 14. The supply connector 20 is connected to a grinding-stock supply and auxiliary-grinding-body return line 22. The discharge connector 21 is followed by a grinding-stock/auxiliary-grinding-body discharge line 23.

Figure 2:
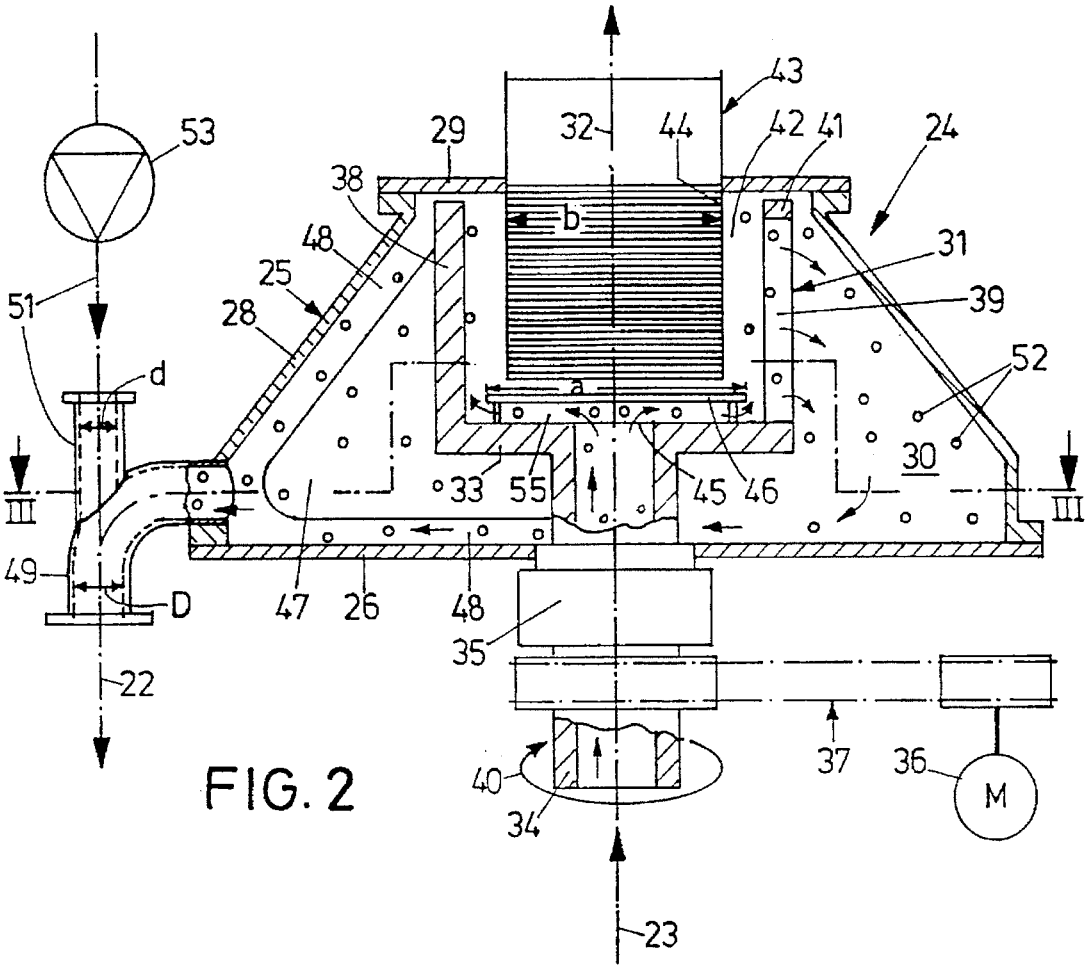
FIG. 2 is a vertical section of the separator device according to FIG. 1.

The grinding-stock/auxiliary-grinding-body discharge line 23 leads from the agitator mill 1 to a grinding-stock/auxiliary-grinding-body separator device 24 separate from the latter. This separator device 24 shown in detail in FIGS. 2 and 3 comprises a casing 25, which is supported on a stand 27 (roughly outlined) by a base plate 26 forming part of the casing 25. It comprises a jacket 28 substantially in the shape of a truncated cone, which is joined to the base plate 26 and of which the upper end opposite to the base plate 26 is closed by means of a cover 29. A cup-shaped or cage-type rotor 31 drivable to rotate about a vertical axis 32 is disposed in the casing 25. An outer chamber 30 forms between the rotor 31 and the casing 25. The rotor 31 comprises a closed disk 33 that is tightly united with a hollow shaft 34. This hollow shaft 34 passes through the base plate 26, on which it is rotatably supported by means of a bearing 35. The hollow shaft 34 and thus the rotor 31 are driven to rotate by a motor 36 via a V-belt drive 37 acting upon the hollow shaft 34.

Figure 3:
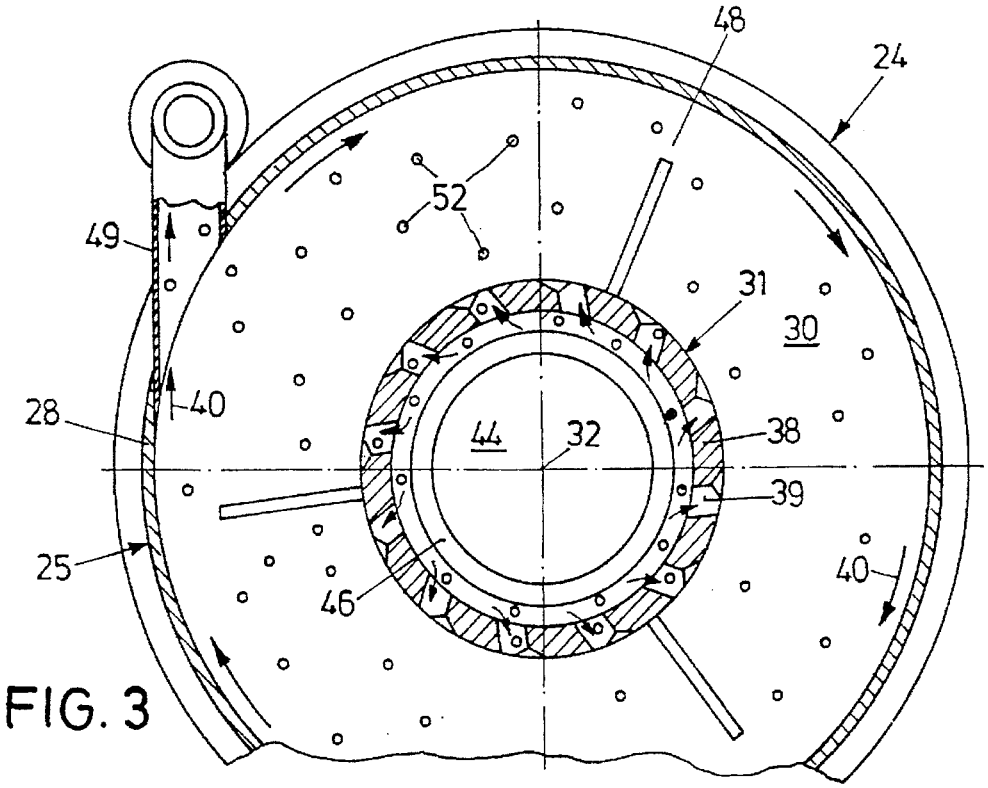
FIG. 3 is a cross-section of the separator device on the section line III—III of FIG. 2.

The rotor 31 further comprises a cylindrical wall 38 contiguous to the disk 33. This cylindrical wall 38 is provided with passages 39, which—as seen in FIG. 3—are formed to trail from the inside outwards referred to the direction of rotation 40. At the open end of the rotor 31, the passages 39 are closed by a ring 41 finishing the cylindrical wall 38 of the rotor 31. This ring 41 is directly adjacent to the cover 29.

A filter cylinder 44, which passes through the cover 29 and can be removed upwards, projects from above into the inner chamber 42 of the rotor 31 as an auxiliary-grinding-body retaining device 43.

A deflector disk 46 is attached to the disk 33 in front of the junction 45 where the hollow shaft 34 opens into the inner chamber 42 of the rotor 31; the deflector disk 46 extends as far as into the proximity of the cylindrical wall 38 and has a diameter a exceeding the diameter b of the filter cylinder 44. To the outside of the cylindrical wall 38 of the rotor 31, driving wings 47 are attached, which fill the free cross-sectional area between the rotor 31 on the one hand and the base plate 26 and the jacket 28 on the other, leaving open a gap 48.

Adjoining the base plate 26, an auxiliary-grinding-body return pipe socket 49 discharges from the outer chamber 30 through the jacket 28. This pipe socket 49 is guided out of the outer chamber 30 substantially tangentially on a radial plane relative to the axis 32—as seen in FIG. 3. It is disposed such that the direction of rotation 40 of the circumference of the wings 47 extends into it tangentially. This pipe socket 49 is a quadrant pipe that passes into the grinding-stock supply and auxiliary-grinding-body return line 22, which, in this area, extends straight and parallel to the axis 32 and is directly adjacent to the casing 25. This line 22 leads to the supply connector 20 of the agitator mill 1. In alignment with the line 22, a grinding-stock supply line 51 opens into the pipe socket 49; its inside diameter d is less than the inside diameter D of the grinding-stock supply and auxiliary-grinding-body return line 22. This helps achieve a flow rate in the grinding-stock supply line 51 which exceeds the flow rate in the line 22 and the pipe socket 49.

The grinding chamber 15 of the agitator mill 1 is filled with auxiliary grinding bodies 52 to a considerable extent. Grinding stock is fed in usual manner to the grinding-stock supply line 51 by means of a grinding-stock pump 53, the grinding stock reaching the grinding chamber 15 of the agitator mill 1 via the grinding-stock supply and auxiliary-grinding-body return line 22 and the grinding-stock/auxiliary-grinding-body supply connector 20 that is bent by 180°. In the grinding chamber 15, the grinding stock and the auxiliary grinding bodies 52 are subjected to an intensive dispersing, grinding and shearing process by means of the high-speed agitator elements 19, this mix flowing through the grinding chamber 15 in the direction towards the discharge connector 21. Since, in the present embodiment, the discharge connector 21 is disposed concentrically of the central longitudinal axis 16, the auxiliary grinding bodies 52 are, to a considerable extent, centrifuged radially outwards owing to their higher density as compared to the grinding stock. The grinding stock treated and a smaller part of auxiliary grinding bodies 52 will flow off through the discharge socket 21 and is supplied to the hollow shaft 34 of the separator device 24 via the grinding-stock/auxiliary-grinding-body discharge line 23. The deflector disk 46 provides for the stream of grinding stock and auxiliary grinding bodies to be deflected radially outwards, the grinding stock and the auxiliary grinding bodies 52 being accelerated in the gap 55 between the disk 33 and the deflector disk 46 in the direction of rotation 40 of the rotor 31. When the auxiliary grinding bodies 52, coming from the gap 55, enter the inner chamber 42 of the rotor 31 in the neighborhood of the cylindrical wall 38, they are catapulted off outwards radially to the axis 32 via the passages 39 into the outer chamber 30 of the casing 25 located outside of the rotor 31. The grinding stock is discharged from the grinding-stock/auxiliary-grinding-body separator device 24 via the filter cylinder 44.

The auxiliary grinding bodies 52 catapulted out of the rotor 31 are forced into the pipe socket 49 by means of the wings 47. The increased flow rate mentioned above of the grinding stock in the grinding-stock supply line 51 as compared to the flow rate in the grinding-stock supply and auxiliary-grinding-body return line 22 causes the auxiliary grinding bodies 52 to be well distributed in the grinding stock, which results in a considerable hydraulic transport of the auxiliary grinding bodies 52 back to the agitator mill 1. Moreover, this increased flow rate prevents the auxiliary grinding bodies 52 from flowing back into the pipe socket 49.

Figure 4:
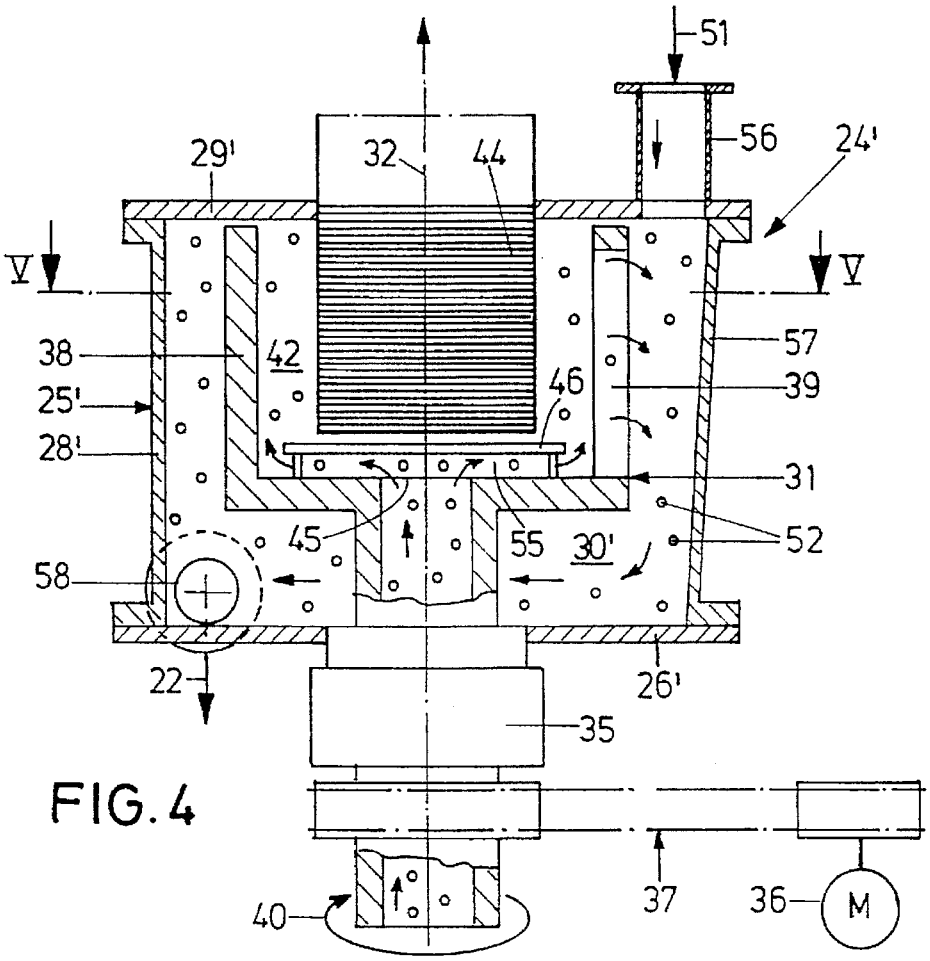
FIG. 4 is a vertical longitudinal section of a second embodiment of a separator device.
Figure 5:
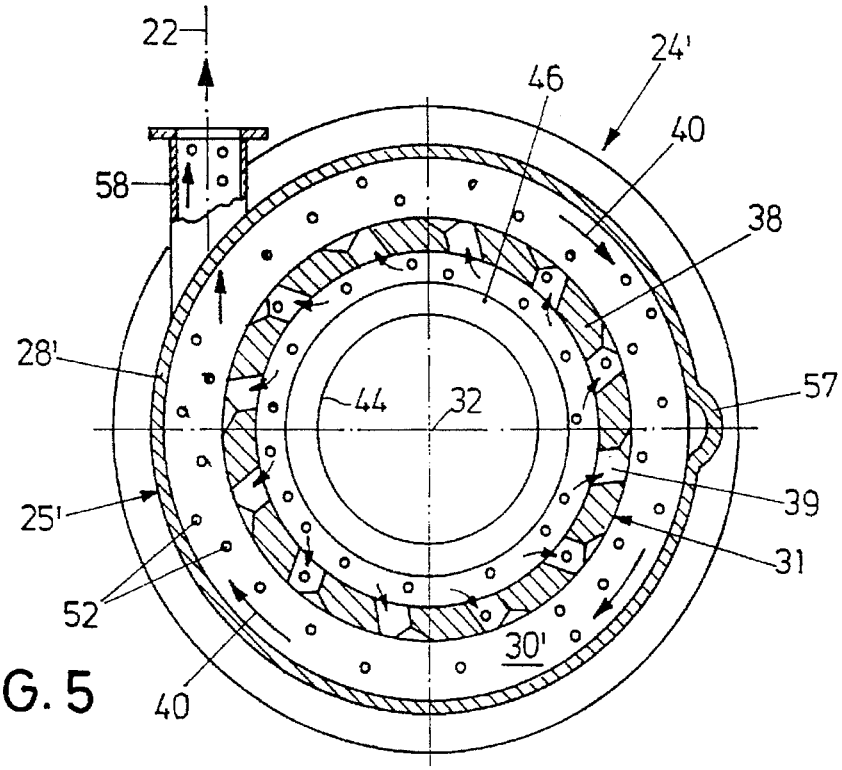
FIG. 5 is a cross-section of the second embodiment of a separator device on the section line V—V of FIG. 4.

FIGS. 4 and 5 illustrate another embodiment of a grinding-stock/auxiliary-grinding-body separator device 24'. In as much as this separator device 24' comprises parts that are identical with the separator device 24 according to FIGS. 2 and 3, identical reference numerals are used; parts of identical function, but which differ constructionally, have identical reference numerals, however provided with a prime. There is no need of renewed description.

The separator device 24' comprises a casing 25' with a substantially cylindrical jacket 28'. The grinding-stock supply line 51 opens into the outer chamber 30' of the casing 25' via a supply connector 56. In alignment with the supply connector 56, the jacket 28' of the casing 25' is provided with a bulging 25' that tapers towards the base plate 26'. Diametrically opposite the supply connector 56, a grinding-stock discharge and auxiliary-grinding-body return connector 58 discharges from the outer chamber 30' through the jacket 28', and that in the proximity of the base plate 26'. As seen in FIG. 5—this connector 58 is disposed tangentially to the direction of rotation 40.

The functioning of the separator device 24' differs from that of the separator device 24 in that after the auxiliary grinding bodies 52 have been catapulted off into the outer chamber 30' of the casing 25', the auxiliary grinding bodies 52 are taken along by the grinding stock supplied to the outer chamber 30' via the supply connector 56. The untreated fresh grinding stock and the catapulted auxiliary grinding bodies 52 are accelerated by the rotor 31 in the direction of rotation 40 and flow through the outer chamber 30' approximately helically in the direction towards the base plate 26', where they are forced out of the separator device 24' by means of the connector 58. This is from where the mix of auxiliary grinding bodies 52 and of untreated grinding stock is supplied to the agitator mill 1 via the grinding-stock supply and auxiliary-grinding-body return line 22.

Figure 6:
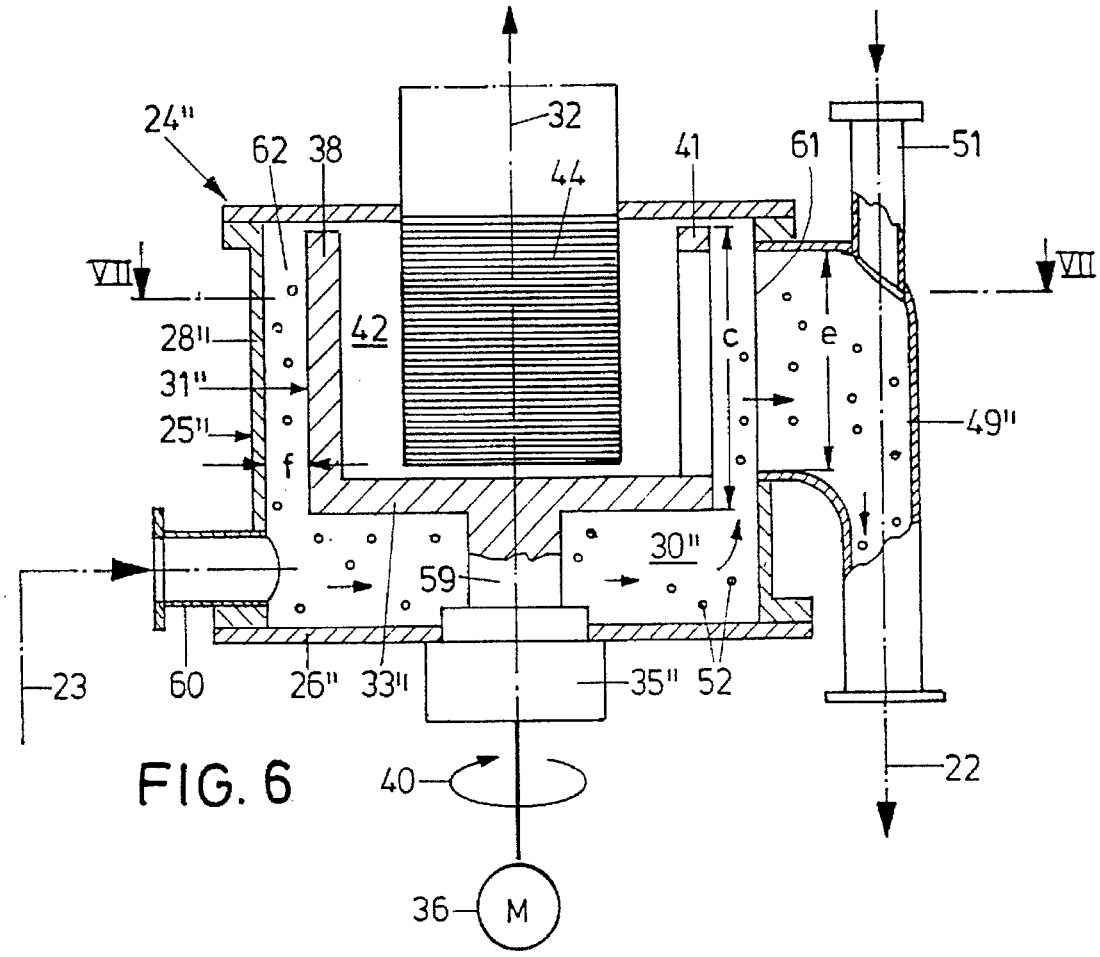
FIG. 6 is a vertical longitudinal section of a third embodiment of a separator device.
Figure 7:
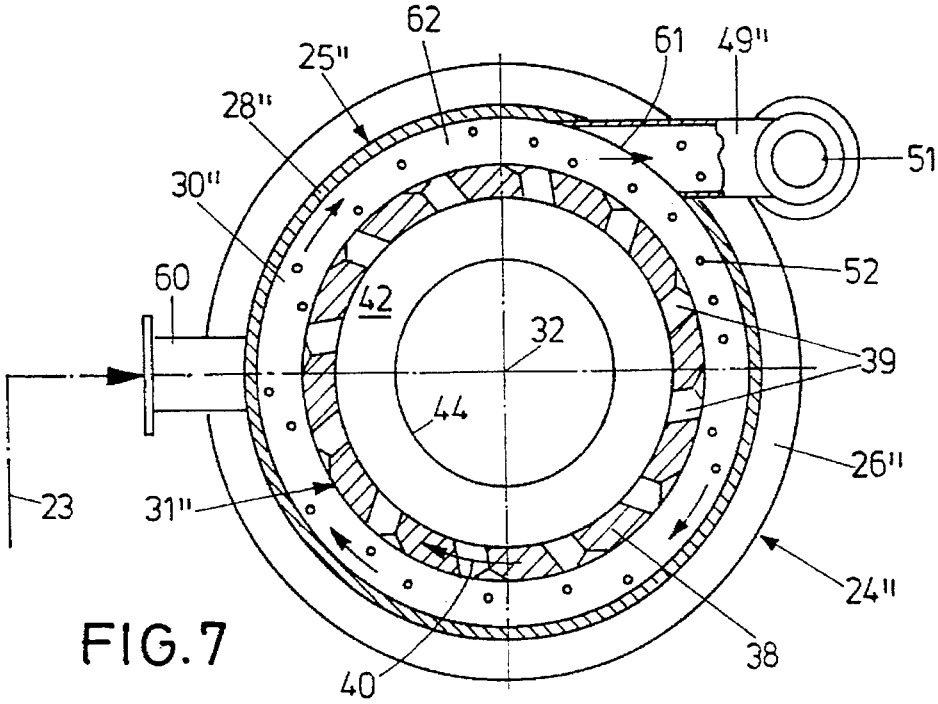
FIG. 7 is a cross-section of the third embodiment of a separator device on the section line VII—VII of FIG. 6.

FIGS. 6 and 7 illustrate another embodiment of a grinding-stock/auxiliary-grinding-body separator device 24". In as much as there are parts that are identical with the preceding embodiments, identical reference numerals are used. Parts of identical function, but differing constructionally, have identical reference numerals, however provided with a double prime. In this regard, there is no need of renewed description.

The rotor 31" is attached to a solid shaft 59, which is directly driven by a motor 36. The grinding-stock/auxiliary-grinding-body discharge line 23 coming from the agitator mill 1 opens into the outer chamber 30" of the casing 25" by way of a supply connector 60, and that radially to the axis 32 and parallel and contiguous to the base plate 26".

The rotor 31" has a length c that exceeds the length e of an outlet 61 that opens into the auxiliary-grinding-bodypipe socket 49". The portion of the outer chamber 30" between the rotor 31" and the jacket 28" forms an annular space 62, the radial extension f of which amounts to 10 to 50 mm.

The auxiliary-grinding-body outlet 61, elongate in the direction of the axis 32, is followed by an auxiliary-grinding-body return pipe socket 49"—approximately box-type in the lateral view of FIG. 6—the actual position of which is tangential to the casing 25", as seen in FIG. 7. It is displaced in FIG. 6 for an illustration of a longitudinal section to be possible.

In the embodiment according to FIGS. 6 and 7, the mix of treated grinding stock and auxiliary grinding bodies 52 coming from the agitator mill 1 flows into the outer chamber 30" between the disk 33" and the base plate 26'. During this process, this mix is accelerated in the direction of rotation 40. In the annular space 62, the auxiliary grinding bodies 52 are catapulted off via the outlet 61 into the auxiliary-grinding-body return pipe socket 49"; the grinding stock passes through the passages 39 of the rotor 31" into the latter's inner chamber 42 and flows off through the filter cylinder 44.

Figure 8:
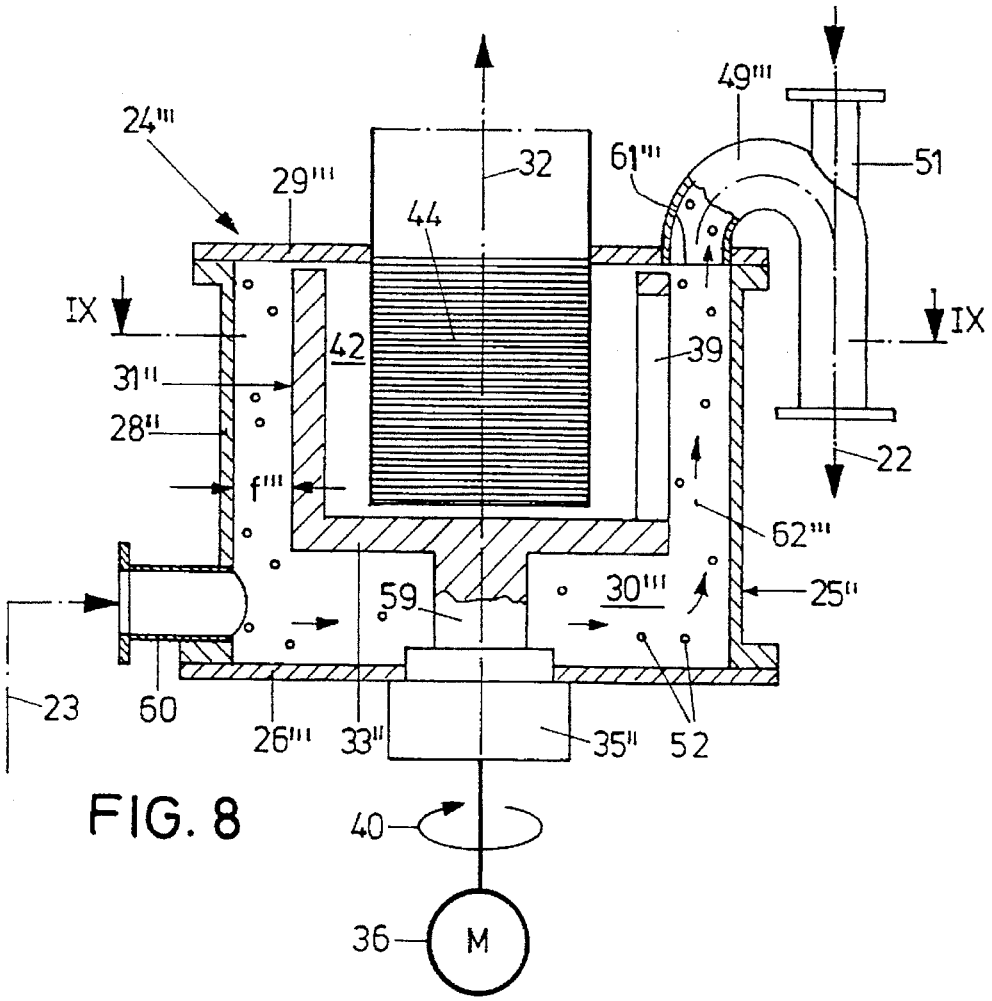
FIG. 8 is a vertical longitudinal section of a fourth embodiment of a separator device.
Figure 9:
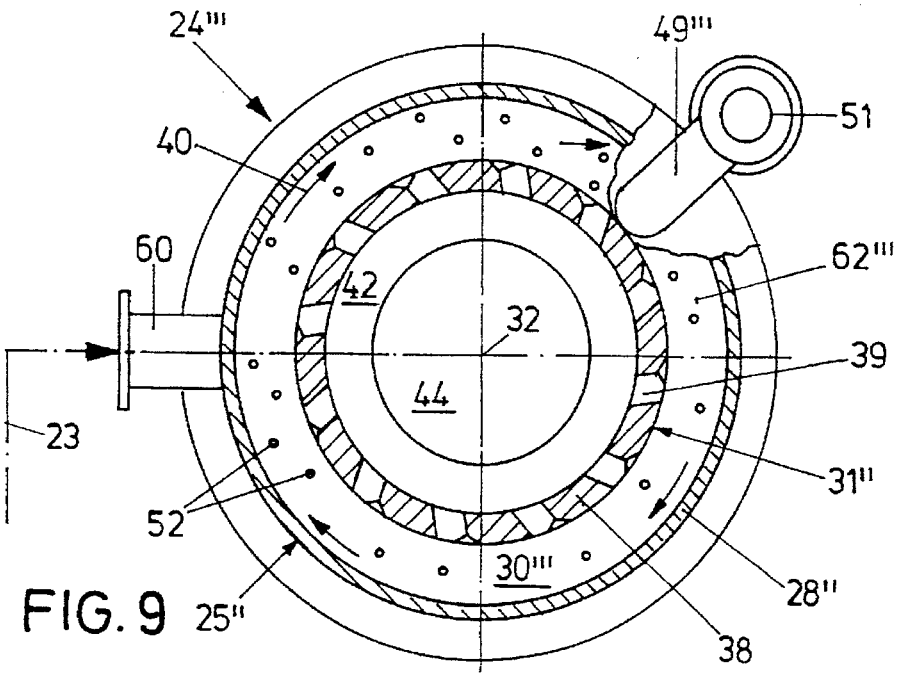
FIG. 9 is a cross-section of the fourth embodiment of a separator device on the section line IX—IX of FIG. 8.

FIGS. 8 and 9 illustrate another embodiment of a grinding-stock/auxiliary-grinding-body separator device 24'", which, in terms of construction, is largely identical with the separator device 24" according to FIGS. 6 and 7. Identical parts have identical reference numerals and parts of identical function, but differing constructionally, have the same reference numerals, however provided with a triple prime. There is no need of renewed description.

The auxiliary-grinding-body outlet 61'" is located in the upper portion of the cover 29'". Consequently, the annular space 62'" between the rotor 31" and the cylindrical jacket 28" is larger than that of the separator device 24" according to FIGS. 6 and 7, i.e. the extension f'" of the annular space 62'" radial to the axis 32 is 25 to 100 mm. The auxiliary-grinding-body outlet 61'" is followed by an auxiliary-grinding-body return pipe socket 49'" in the form of a 180° elbow.

In this embodiment, the mix, coming from the agitator mill 1, of treated grinding stock and auxiliary grinding bodies 52 flows through the outer chamber 30'" between the disk 33" of the rotor 31" and the base plate 26", whereupon it is accelerated in the direction of rotation 40 and enters the comparatively wide annular space 62'". Here, the treated grinding stock passes through the passages 39 into the inner chamber 42 of the rotor 31" and flows off via the filter cylinder 44. The auxiliary grinding bodies 52 are discharged from the outer chamber 30'" through the outlet 61'" and are supplied to the hydraulic return transport to the agitator mill 1 via the pipe socket 49'".

What is claimed is:

1. An agitator mill comprising a grinding receptacle (11) enclosing a grinding chamber (15) with a central longitudinal axis (16), an agitator unit rotatably disposed in the grinding chamber (11) concentrically of said central longitudinal axis (16), a drive motor (4) coupled with the agitator unit, a grinding-stock/auxiliary-grinding-body discharge line (23) leading out of the grinding chamber (15), a grinding-stock/auxiliary-grinding-body separator device (24, 24', 24", 24'") separate from the agitator mill (1) and connected to the discharge line (23), a grinding-stock supply and auxiliary-grinding-body return line (22), which has a direction and is connected to the separator device (24, 24', 24", 24'") and a grinding-stock supply line (51) on the one hand, and to the grinding chamber (15) on the other hand, a grinding-stock pump (53) arranged in the grinding-stock supply line (51), wherein the grinding receptacle (11), the grinding-stock/auxiliary-grinding-body discharge line (23), the separator device (24, 24', 24", 24'") and the grinding-stock supply and auxiliary-grinding-body return line (22) form a closed system, and wherein the grinding-stock pump (53) disposed in the grinding-stock supply line (51) serves as a pumping device for grinding stock and auxiliary grinding bodies (52) in the grinding-stock supply and auxiliary-grinding-body return line (22).

2. An agitator mill according to claim 1, wherein the separator device (24, 24', 24", 24'") is connected to the grinding-stock supply and auxiliary-grinding-body return line (22) by an auxiliary-grinding-body return pipe socket (49, 49", 49'") in the form of an elbow, which passes into the grinding-stock supply and auxiliary-grinding-body return line (22), and wherein the grinding-stock supply line (51) opens into the pipe socket (49, 49", 49'") substantially in the direction of the grinding-stock supply and auxiliary-grinding-body return line (22).

3. An agitator mill according to claim 1, wherein the separator device (24, 24', 24", 24'") has a casing (25, 25', 25", 25'"), in which a rotor (31, 31") drivable to rotate is disposed, defining between itself and the casing (25, 25', 25", 25'") an outer chamber (30, 30', 30", 30'"), which is connected with the grinding-stock supply and auxiliary-grinding-body return line (22), wherein the rotor (31, 31") defines an inner chamber (42), in which an auxiliary-grinding-body retaining device (43) is disposed, through which grinding stock is dischargeable to the outside, and wherein the inner chamber (42) is connected with the outer chamber (30, 30', 30", 30'") by passages (39) provided in the rotor (31, 31").

4. An agitator mill according to claim 3, wherein the rotor (31, 31") of the separator device (24, 24', 24", 24'") is drivable by a motor (36) that is separate from the drive motor (4) of the agitator unit.

5. An agitator mill according to claim 4, wherein the motor (36) for driving the rotor (31, 31') is a speed-variable motor.

6. An agitator mill according to claim 3, wherein the auxiliary-grinding-body retaining device (43) is removable upwards from the casing (25, 25', 25", 25'") of the separator device (24, 24', 24", 24'").

7. An agitator mill according to claim 3, wherein the grinding-stock/auxiliary-grinding-body discharge line (23) opens into the inner chamber (42) of the rotor (31) by way of a hollow shaft (34) of the rotor (31).

8. An agitator mill according to claim 3, wherein the separator device (24, 24', 24", 24'") is connected to the grinding-stock supply and auxiliary-grinding-body return line (22) by an auxiliary-grinding-body return pipe socket (49, 49", 49'") in the form of an elbow, which passes into the grinding-stock supply and auxiliary-grinding-body return line (22), wherein the grinding-stock supply line (51) opens into the pipe socket (49, 49", 49'") substantially in the direction of the grinding-stock supply and auxiliary-grinding-body return line (22), and wherein the auxiliary-grinding-body return pipe socket (49'") discharges from the outer chamber (30'") of the separator device (24'").

9. An agitator mill according to claim 3, wherein the separator device (24, 24', 24", 24'") is connected to the grinding-stock supply and auxiliary-grinding-body return line (22) by an auxiliary-grinding-body return pipe socket (49, 49", 49'") in the form of an elbow, which passes into the grinding-stock supply and auxiliary-grinding-body return line (22), wherein the grinding-stock supply line (51) opens into the pipe socket (49, 49", 49'") substantially in the direction of the grinding-stock supply and auxiliary-grinding-body return line (22), and wherein the rotor (31, 31") overlaps the auxiliary-grinding-body return pipe socket (49, 49").

10. An agitator mill according to claim 3, wherein driving wings (47) are attached to the outside of the rotor (31).

11. An agitator mill according to claim 1, wherein the grinding-stock/auxiliary-grinding-body discharge line (23) opens into the outer chamber (30", 30'") of the separator device (24', 24'").

* * * * *